US010222182B1

(12) United States Patent
Cardoza et al.

(10) Patent No.: US 10,222,182 B1
(45) Date of Patent: Mar. 5, 2019

(54) MODULAR SHAPED CHARGE SYSTEM (MCS) CONICAL DEVICE

(71) Applicant: Department of the Navy, Washington, DC (US)

(72) Inventors: Normary Camacho Cardoza, LaPlata, MD (US); Nicholas Shaker, Springfield, VA (US); Michael G. Craft, Waldorf, MD (US); Lonnie Frericks, King George, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/731,876

(22) Filed: Aug. 18, 2017

(51) Int. Cl.
*F42B 1/036* (2006.01)
*F42B 1/032* (2006.01)
*F42B 1/028* (2006.01)

(52) U.S. Cl.
CPC ..... *F42B 1/036* (2013.01); *F42B 1/028* (2013.01); *F42B 1/032* (2013.01)

(58) Field of Classification Search
CPC ..... F42B 1/028
USPC ..... 102/306, 307
See application file for complete search history.

(56) References Cited

U.S. PATENT DOCUMENTS 4,444,116 A * 4/1984 Mitard ..... F42B 27/00 102/476
4,598,884 A 7/1986 Speer
H344 H 10/1987 Williamsen et al.
4,784,061 A * 11/1988 Christopher ..... E21B 43/117 102/306
4,969,397 A * 11/1990 Gunther ..... F42B 5/02 102/233
5,081,929 A 1/1992 Mertens
5,157,221 A * 10/1992 Ronn ..... F42C 19/07 102/216
6,588,344 B2 7/2003 Clark et al.
6,857,372 B2 2/2005 Renaud-Bezot et al.
7,011,027 B2 3/2006 Reese et al.
7,654,458 B1 2/2010 Kokodis et al.
7,712,416 B2 5/2010 Pratt et al.
8,220,395 B1 7/2012 Gorman et al.
8,522,682 B1 9/2013 Genson et al.
8,985,024 B2 3/2015 Yang et al.
2006/0102040 A1 3/2006 Johnansson

OTHER PUBLICATIONS

"Post-Tagged 'Zero Point'" available from Soldier Systems on line periodical, Sep. 25, 2013: http://soldiersystems.net/tag/zero-point/.

* cited by examiner

*Primary Examiner* — Samir Abdosh
(74) *Attorney, Agent, or Firm* — Frederic Zimmerman

(57) ABSTRACT

A modular shaped charge system including a housing including a circular opening; an attachment ring having a diameter complementary to a diameter of the opening of the housing. The attachment ring configured to snap fit into the opening of the housing. A liner including a cone shape with a base diameter complementary to the diameter of the attachment ring. The liner is configured to snap fit into the attachment ring. The apex of the liner is positioned inside the housing. An air gap cover including a cone shape with a base diameter complementary to the diameter of the attachment ring. The air gap cover is configured to thread into the attachment ring, and the apex of the air gap cover is positioned outside the housing.

20 Claims, 5 Drawing Sheets

MODULAR SHAPED CHARGE SYSTEM (MCS) CONICAL DEVICE

GOVERNMENT INTEREST

The embodiments described herein may be manufactured and used by or for the Government of the United States of America for government purposes without the payment of any royalties thereon or therefore.

BACKGROUND

Technical Field

The embodiments herein generally relate to explosive systems, and more particularly to modular shaped charge system (MCS) explosives.

Description of the Related Art

Conventionally, shaped charges are used in guns. A shaped charge typically includes a housing component, an explosive head portion, and a liner that retains the explosive portion within the housing component. A charge detonates and launches a metal projectile towards a main charge, which then detonates upon impact. This action collapses a metal shaped charge liner, which is projected forward through the mechanical impact fuze and into the target. At the same time the main charge fragments the body of the grenade and throws those fragments outward.

SUMMARY

In view of the foregoing, an exemplary embodiment herein provides a modular shaped charge system including a housing, which includes a circular opening; an attachment ring having a diameter complementary to a diameter of the opening of the housing, where the attachment ring is configured to snap fit into the opening of the housing; a liner including a cone shape with a base diameter complementary to the diameter of the attachment ring, where the liner is configured to snap fit into the attachment ring, and where the apex of the liner is positioned inside the housing; and an air gap cover including a cone shape with a base diameter complementary to the diameter of the attachment ring, where the air gap cover is configured to thread into the attachment ring, and where the apex of the air gap cover is positioned outside the housing. A first joint between the attachment ring and the housing, a second joint between the liner and the attachment ring, and a third joint between the air gap cover and the attachment ring may be configured to be air tight.

The first joint, the second joint, and the third joint may be sealed with glue. An outer surface of the housing may include first railings and an outer surface of the attachment ring may include second railings. The first railings may be complementary with the second railings. The first railings may include a substantially similar width and be configured to be aligned with the second railings. A height of the air gap cover may be greater than a height of the liner. The liner may be made of a copper material.

Another embodiment provides a method of assembling a modular shaped charge system, the method includes attaching an attachment ring to a housing, where the housing includes a circular opening, where the attachment ring includes a diameter complementary to a diameter of the opening of the housing, and where the attachment ring is configured to snap fit into the opening of the housing; attaching a liner to the attachment ring, where the liner includes a cone shape with a base diameter complementary to the diameter of the attachment ring, where the liner is configured to snap fit into the attachment ring, and where an apex of the liner is positioned inside the housing; and attaching an air gap cover to the attachment ring, where the air gap cover includes a cone shape with a base diameter complementary to the diameter of the attachment ring, where the air gap cover is configured to thread into the attachment ring, and where an apex of the air gap cover is positioned outside the housing.

The method may further include tightening a first joint between the attachment ring and the housing so that the first joint is air tight; tightening a second joint between the liner and the attachment ring so that the second joint is air tight; and tightening a third joint between the air gap cover and the attachment ring so that the third joint is air tight. The method may further include sealing the first joint, the second joint, and the third joint with glue. The method may further include aligning first railings on an outer surface of the housing with second railings on an outer surface of the attachment ring. The liner may include copper material.

Another embodiment provides a modular shaped charge device including an attachment ring configured to snap fit into a housing; a liner including a cone shape and configured to snap fit into the attachment ring, where an apex of the liner is positioned inside the housing; and an air gap cone includes a cone shape and configured to thread into the attachment ring, where an apex of the air gap cover is positioned outside the housing. A first joint between the attachment ring and the housing, a second joint between the liner and the attachment ring, and a third joint between the air gap cover and the attachment ring may be configured to be air tight.

The first joint, the second joint, and the third joint may be sealed with glue. An outer surface of the housing may include first railings and an outer surface of the attachment ring includes second railings, and where the first railings may be complementary with the second railings. The first railings may include a substantially similar width and are configured to be aligned with the second railings. A height of the air gap cover may be greater than a height of the liner. The liner includes a copper material.

These and other aspects of the exemplary embodiments herein will be better appreciated and understood when considered in conjunction with the following description and the accompanying drawings. It should be understood, however, that the following descriptions, while indicating exemplary embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide modular shaped charge system (MCS) conical device. The embodiments provide an underwater assembly that allows the modular shaped charge system to be used in both above water and underwater applications. Shaped charges may require air gap (or air void) in order for a liner to form a jet in underwater applications. The embodiments herein provide air gaps that are complementary with the modular shaped charge systems. Modular shaped charge systems may also be referred to as modular shaped charge devices.

Figure 1:
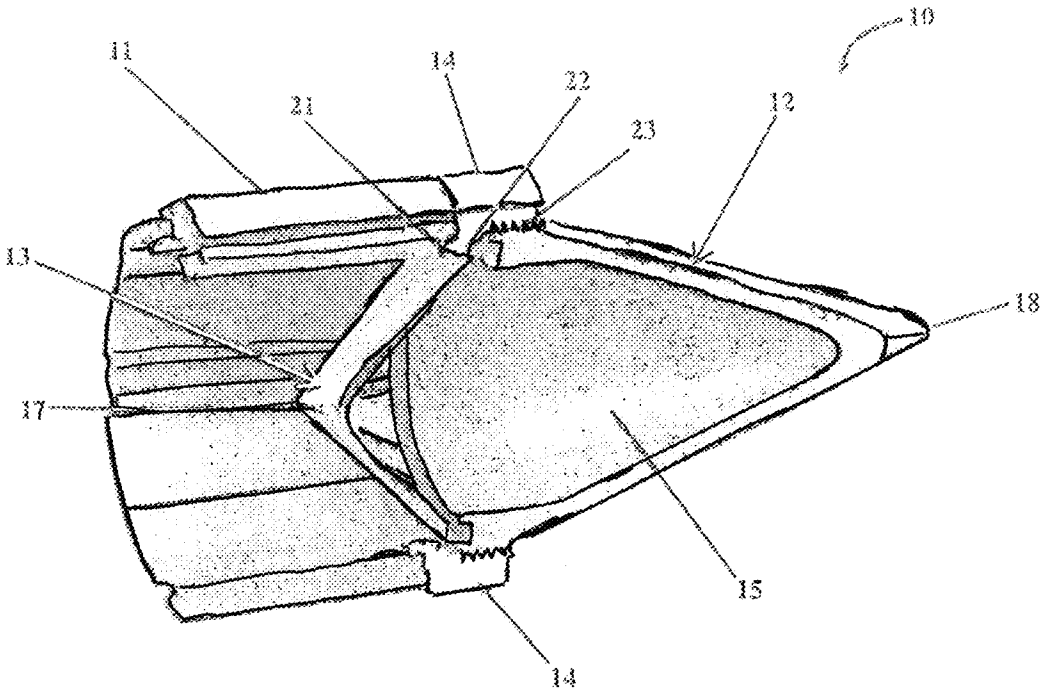
FIG. 1 is a schematic diagram illustrating a modular shaped charge system (MCS) with an air gap according to an embodiment herein.
Figure 2:
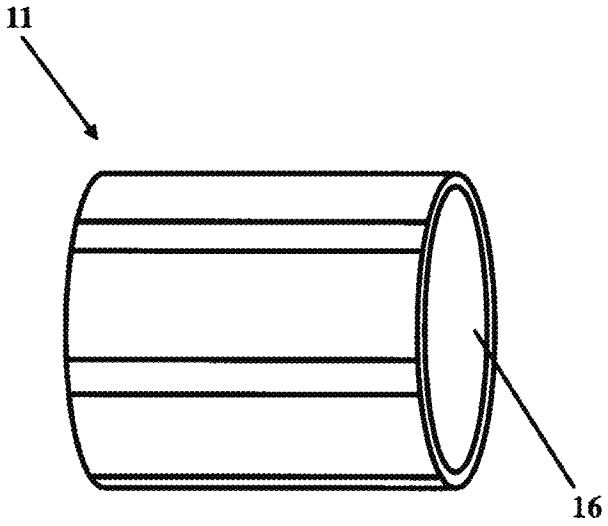
FIG. 2 is a schematic diagram illustrating a housing of a modular shaped charge system according to an embodiment herein.

Referring now to the drawings, and more particularly to FIGS. 1 through 5, where similar reference characters denote corresponding features consistently throughout the figures, there are shown exemplary embodiments. FIG. 1 is a schematic diagram illustrating a modular shaped charge system 10 with an air gap 15, according to an embodiment herein. A modular shaped charge system 10 may include a housing 11. FIG. 2, with reference to FIG. 1, is a schematic diagram illustrating an example of the housing 11 of the modular shaped charge system according to an embodiment. The housing 11 may have a cylindrical shape having a circular opening 16.

The modular shaped charge system 10 may include an attachment ring 14. The attachment ring 14 may be configured to snap fit into the opening 16 of the housing 11. The modular shaped charge system 10 may include a liner 13 having a cone shape. The liner 13 may be configured to snap fit into the attachment ring 14. The apex 17 of the liner 13 may be positioned inside the housing 11. In an exemplary embodiment, liner 13 may include copper material. The modular shaped charge system 10 with air gap 15 may include an air gap cover 12 having a cone shape. The air gap cover 12 may be configured to thread into the attachment ring 14. In an embodiment, the apex 18 of the air gap cover 12 may be positioned outside the housing 11.

Figure 3:
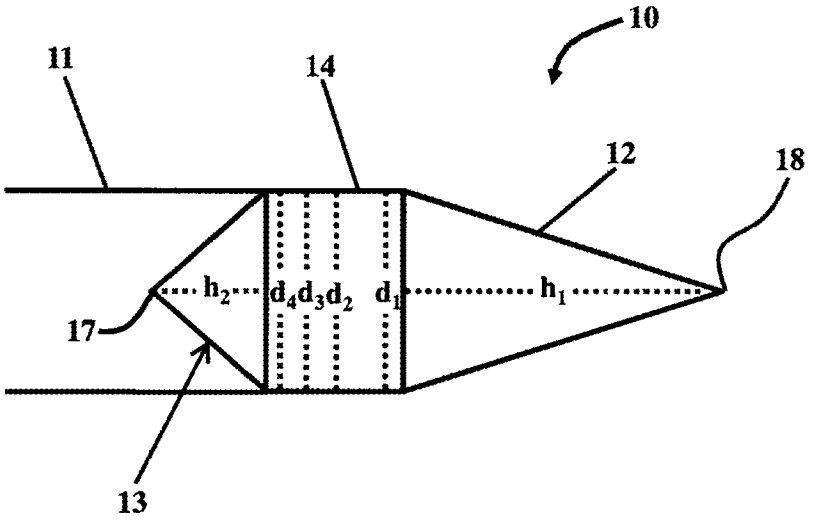
FIG. 3 is a schematic diagram illustrating a configuration of a modular shaped charge system with an air gap according to an embodiment herein.

FIG. 3, with reference to FIGS. 1 through 2, is a schematic diagram illustrating a configuration of the modular shaped charge system 10 with the air gap 15 according to an embodiment. The configuration labels shown in FIG. 3 may be in general proximity of the parts they refer to. The attachment ring 14 may have a diameter $d_2$ complementary to a diameter $d_4$ of the opening 16 of the housing 11. The liner 13 may have a base diameter $d_3$ complementary to the diameter $d_2$ of the attachment ring 14. The air gap cover 12 may have a cone shape with a base diameter $d_1$ complementary to the diameter $d_2$ of the attachment ring 14. In an embodiment the height $h_1$ of the air gap cover 12 may be greater than the height $h_2$ of the liner 13.

In an embodiment, the joint 21 between the attachment ring 14 and the housing 11 may be configured to be air tight. In an embodiment, the joint 22 between the liner 13 and the attachment ring 14 may be configured to be air tight. In an embodiment, the joint 23 between the air gap cover 12 and the attachment ring 14 may be configured to be air tight.

In an embodiment, the joint 21 between the attachment ring 14 and the housing 11 may be sealed with plastic glue. In an embodiment, the joint 22 between the liner 13 and the attachment ring 14 may be sealed with plastic glue. In an embodiment, the joint 23 between the air gap cover 12 and the attachment ring 14 may be sealed with plastic glue.

Figure 4:
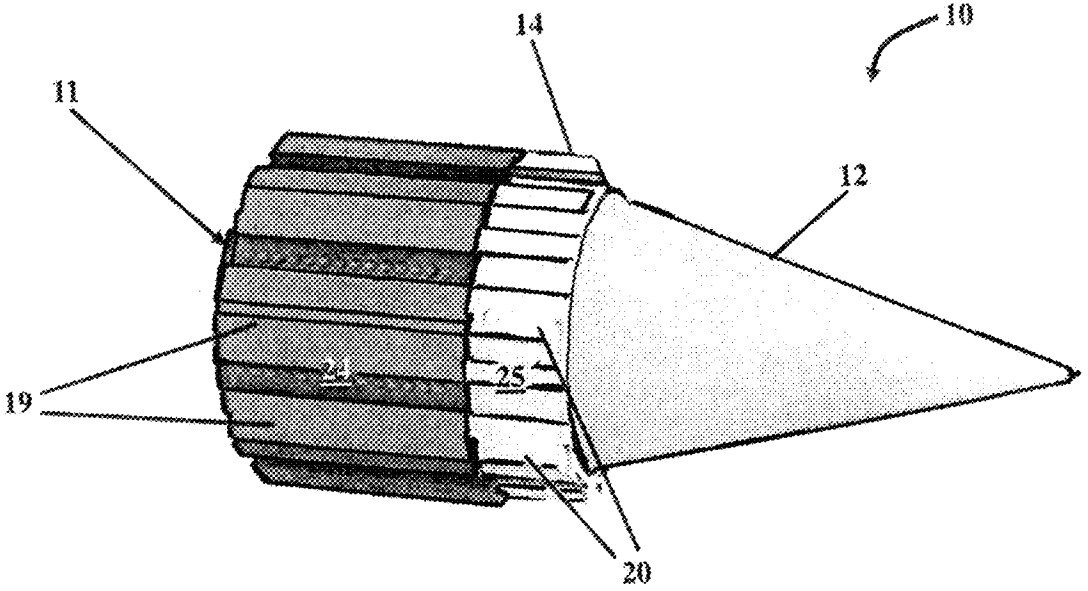
FIG. 4 is a schematic diagram illustrating railings on the exterior of a modular shaped charge system with air gap according to an embodiment herein.

FIG. 4, with reference to FIGS. 1 through 3, is a schematic diagram illustrating railings 19 on the exterior of the modular shaped charge system 10 according to an embodiment. An outer surface 24 of the housing 11 includes first railings 19 and an outer surface 25 of the attachments ring 14 includes second railings 20. In an embodiment, the first railings 19 may be complementary with the second railings 20 to simplify directing the modular shaped charge device to a target (not shown). In an embodiment, the first railings 19 may have a similar width and be configured to be aligned with the second railings 20.

Figure 5:
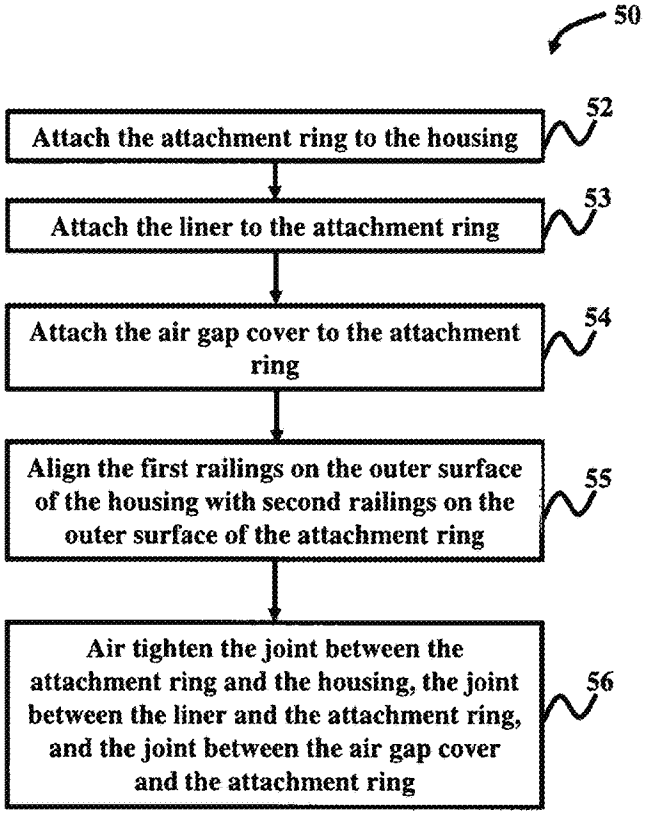
FIG. 5 is a flow diagram illustrating a method of assembling a modular shaped charge system with air gap according to an embodiment herein.

FIG. 5, with reference to FIGS. 1 through 4, is a flow diagram illustrating a method 50 for assembling a modular shaped charge system 10 with air gap 15 according to an embodiment. The order of steps of method 50 is not limited to the order illustrated in FIG. 5. At step 52, method 50 attaches the attachment ring 14 to the housing 11. At step 53, method 50 attaches the liner 13 to the attachment ring 14. At step 54, method 50 attaches the air gap cover 12 to the attachment ring 14. At step 55, method 50 aligns the first railings 19 on an outer surface 24 of the housing 11 with the second railings 20 on the outer surface 25 of the attachment ring 14. At step 56, method 50 air tightens the joint 21 between the attachment ring 14 and the housing 11, the joint 22 between the liner 13 and the attachment ring 14, and the joint 23 between the air gap cover 12 and the attachment ring 14.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A modular shaped charge system comprising:

a housing comprising a circular opening;

an attachment ring including a first diameter complementary to a second diameter of said opening of said housing, wherein said attachment ring is configured to snap fit into said opening of said housing;

a liner comprising a cone shape with a base diameter complementary to said first diameter of said attachment ring, wherein said liner is configured to snap fit into said attachment ring, and wherein the apex of said liner is positioned inside said housing; and an air gap cover comprising a cone shape with a base diameter complementary to said first diameter of said attachment ring, wherein said air gap cover is configured to thread into said attachment ring, and wherein the apex of said air gap cover is positioned outside said housing.

2. The system of claim 1, wherein a first joint between said attachment ring and said housing, a second joint between said liner and said attachment ring, and a third joint between said air gap cover and said attachment ring are configured to be air tight.

3. The system of claim 2, wherein said first joint, said second joint, and said third joint are sealed with glue.

4. The system of claim 1, wherein an outer surface of said housing comprises first railings and an outer surface of said attachment ring comprises second railings, and wherein said first railings are complementary with said second railings.

5. The system of claim 4, wherein said first railings comprise a substantially similar width and are configured to be aligned with said second railings.

6. The system of claim 1, wherein a height of said air gap cover is greater than a height of said liner.

7. The system of claim 1, wherein said liner comprises copper material.

8. A method of assembling a modular shaped charge system, said method comprising:

attaching an attachment ring to a housing, wherein said housing comprises a circular opening, wherein said attachment ring comprises a first diameter complementary to a second diameter of said opening of said housing, and wherein said attachment ring is configured to snap fit into said opening of said housing;

attaching a liner to said attachment ring, wherein said liner comprises a cone shape with a base diameter complementary to said first diameter of said attachment ring, wherein said liner is configured to snap fit into said attachment ring, and wherein an apex of said liner is positioned inside said housing; and attaching an air gap cover to said attachment ring, wherein said air gap cover comprises a cone shape with a base diameter complementary to said first diameter of said attachment ring, wherein said air gap cover is configured to thread into said attachment ring, and wherein an apex of said air gap cover is positioned outside said housing.

9. The method of claim 8, further comprising:

tightening a first joint between said attachment ring and said housing so that said first joint is air tight;

tightening a second joint between said liner and said attachment ring so that said second joint is air tight; and tightening a third joint between said air gap cover and said attachment ring so that said third joint is air tight.

10. The method of claim 9, further comprising sealing said first joint, said second joint, and said third joint with glue.

11. The method of claim 8, further comprising aligning first railings on an outer surface of said housing with second railings on an outer surface of said attachment ring.

12. The method of claim 8, wherein said liner comprises copper material.

13. A modular shaped charge device comprising:

an attachment ring being configured to snap fit into a housing;

a liner comprising a cone shape and being configured to snap fit into said attachment ring, wherein an apex of said liner is positioned inside said housing; and an air gap cover comprising a cone shape and being configured to thread into said attachment ring, wherein an apex of said air gap cover is positioned outside said housing.

14. The device of claim 13, wherein a first joint between said attachment ring and said housing, a second joint between said liner and said attachment ring, and a third joint between said air gap cover and said attachment ring are configured to be air tight.

15. The device of claim 14, wherein said first joint, said second joint, and said third joint are sealed with glue.

16. The device of claim 13, wherein an outer surface of said housing comprises first railings and an outer surface of said attachment ring comprises second railings.

17. The device of claim 16, wherein said first railings are complementary with said second railings.

18. The device of claim 16, wherein said first railings comprise a substantially similar width and are configured to be aligned with said second railings.

19. The device of claim 13, wherein a height of said air gap cover is greater than a height of said liner.

20. The device of claim 13, wherein said liner comprises copper material.

* * * * *